US008336347B2

(12) United States Patent
Joukov

(10) Patent No.: US 8,336,347 B2
(45) Date of Patent: Dec. 25, 2012

(54) LOCK ASSEMBLY

(75) Inventor: Oleg Joukov, Zoran (IL)

(73) Assignee: Combi Lock, Moshav Mashen (IL)

( * ) Notice: Subject to any disclaimer, the term of this patent is extended or adjusted under 35 U.S.C. 154(b) by 0 days.

(21) Appl. No.: 13/384,863

(22) PCT Filed: Aug. 2, 2010

(86) PCT No.: PCT/IL2010/000620
§ 371 (c)(1),
(2), (4) Date: Jan. 19, 2012

(87) PCT Pub. No.: WO2011/016025
PCT Pub. Date: Feb. 10, 2011

(65) Prior Publication Data

US 2012/0118030 A1 May 17, 2012

Related U.S. Application Data

(60) Provisional application No. 61/230,760, filed on Aug. 3, 2009.

(51) Int. Cl.
*E05B 47/00* (2006.01)

(52) U.S. Cl. ..... 70/277; 70/278.1; 70/279.1; 70/283.1

(58) Field of Classification Search ..... 70/275–277, 70/278.1–279.1, 280–293
See application file for complete search history.

(56) References Cited

U.S. PATENT DOCUMENTS

| | | | |
|---|---|---|---|
| 5,083,122 | A | 1/1992 | Clark |
| 6,318,138 | B1 | 11/2001 | Mathews et al. |
| 6,418,763 | B1 | 7/2002 | Huang |
| 6,732,664 | B2 | 5/2004 | Worrall |
| 6,918,276 | B2 | 7/2005 | Van Parys |
| 7,017,379 | B1 | 3/2006 | Hsieh |
| 7,516,633 | B1 | 4/2009 | Chang |
| 2005/0086983 | A1 | 4/2005 | Stevens et al. |
| 2007/0056339 | A1 | 3/2007 | Irgens et al. |

OTHER PUBLICATIONS

International Search Report dated Jan. 11, 2011 in corresponding International Application No. PCT/IL2010/000620.

*Primary Examiner* — Suzanne Barrett
(74) *Attorney, Agent, or Firm* — The Law Office of Michael E. Kondoudis

(57) ABSTRACT

A coded lock assembly is introduced in order to improve upon existing coded locks used to control access to protected areas. The lock assembly contains several micro-switches within the anterior portion that can be pushed by a push button on the posterior portion of the lock assembly. In order to unlock the lock assembly, the user must turn an exterior drive handle to the proper position and press the push button. A predetermined sequence of handle turns and push button presses is required to unlock the lock.

9 Claims, 8 Drawing Sheets

LOCK ASSEMBLY

REFERENCE TO CROSS-RELATED APPLICATION

This application claims priority from U.S. Provisional Application No. 61/230,760, filed on Aug. 3, 2009, herein incorporated by reference in its entirety.

FIELD OF THE INVENTION

The present invention relates to a lock assembly, more particularly, to a coded lock assembly.

BACKGROUND OF THE INVENTION

Coded lock assemblies are widely used to control access to protected areas. These locks eliminate the need for a key and with it the problems associated with loss, theft or duplication of the keys. Access is gained to the protected area when the correct combination is entered into the lock, whereby the lock will be opened.

Such lock assemblies are disclosed for example in U.S. Pat. No. 6,732,664 and U.S. patent application, publication number 2007/0056339.

U.S. Pat. No. 6,732,664 describe a locking mechanism for use in an enclosure. The locking mechanism uses existing locks and latches, and configures those using linkages into a mechanism that is not currently available. The mechanism has a latch that holds the door of the enclosure closed. This latch stays in a normally unlocked state until deliberate acts are taking to lock the latch. When a delivery is made, the delivery person opens the unlock door, makes the delivery, and then closes the door and turns rotary latch counter clockwise until it latched in the locked position.

U.S. 2007/0056339 describe a combination lock including a mechanical locking mechanism, a dial and an electronic interface. The mechanical locking mechanism includes a locking member movable between a locked condition and an unlocked condition. The dial is assembled with the locking mechanism such that successive rotation of the dial to a series of one or more predetermined rotational positions causes the locking mechanism to move the locking member from the locked condition to the unlocked condition. The electronic interface is configured to translate incremental rotational position of the dial to corresponding electrical signals and to process the electrical signals and display corresponding incremental positional indicators.

SUMMARY OF THE INVENTION

According to the teaching of the present invention there is provided a lock assembly including: (a) an anterior portion sub-assembly including: (i) a push button; and (ii) an exterior drive handle, wherein the exterior drive handle is adapted for rotational motion around the push button; (b) an intermediate portion sub-assembly including: (i) a lock-cylinder like shaped casing; and (ii) a sprocket wheel, adapted for rotational motion with relation to the lock-cylinder like shaped casing, wherein the intermediate portion sub-assembly is operatively connected to the anterior portion sub-assembly; and (c) a posterior portion sub-assembly including: (i) a housing; (ii) a printed circuit board mounted inside the housing; and (iii) an electric motor mounted inside the housing, wherein the posterior portion sub-assembly is operatively connected to the intermediate portion sub-assembly.

According to further feature of an embodiment of the present invention the intermediate portion sub-assembly further includes: (iii) a sprocket wheel cylinder for transferring torque from the exterior drive handle for rotating the sprocket wheel, mounted at least partially inside the lock-cylinder like shaped casing; and (iv) a square recess of position selector for transferring rotational torque from the exterior drive handle, the square recess of position selector is mounted at least partially inside the lock-cylinder like shaped casing.

According to another feature of an embodiment of the present invention the posterior portion sub-assembly further includes: (iv) a rod for transferring rotational torque and for transferring linear force, the rod is mounted partially inside the housing; (v) a micro-switch tongue disposed on the rod; and (vi) at least one micro-switch disposed on the printed circuit board.

According to another feature of an embodiment of the present invention the posterior portion sub-assembly further includes: (vii) a cam operatively connected to the electric motor; (viii) a power supply operatively connected to the electric motor; (ix) a hollow cylinder disposed on the rod; (x) a stopping member disposed on the rod; and (xi) a flap disposed on the stopping member.

According to further features of an embodiments of the present invention the posterior portion sub-assembly further includes: (xii) a protruding element disposed on the hollow cylinder; (xii) a manual actuator thumb handle disposed on the stopping member; (xiv) a biasing member mounted on the rod; (xv) a first square-shaped protrusion element disposed on the stopping member; and (xvi) a second square-shaped protrusion element disposed on the stopping member.

According to further features of an embodiment of the present invention, by rotating the exterior drive handle, a specific micro-switch from the micro-switch is selected and by pressing the push button the selected micro-switch is activated, wherein entering a right code the electric motor is activated, the cam which is actuated by the electric motor rotates towards the flap of the stopping member, the cam interfaces with the flap of the stopping member forcing them to rotate, thereby releasing the hollow cylinder from the stopping member and enabling the micro-switch tongue to move in the direction of the exterior drive handle, for enabling transferring torque from the exterior handle for rotation of the sprocket wheel.

According to the teaching of the present invention there is provided a method including the stages of: (a) rotating an exterior drive handle, of the lock assembly, to at least one predetermined position; and (b) pushing on a push button, of the lock assembly, at least once according to a predetermined code, causing a manual actuator thumb handle, of the lock assembly, to enable a protruding element, of the lock assembly, to enter a slit, of a stopping member, of the lock assembly, and consequently torque is transferee to a sprocket wheel, of the lock assembly.

According to further features of the present invention the method of operating a lock assembly further includes the stages of: (c) pulling an interior drive handle, of the lock assembly; (d) moving a micro-switch tongue, of the lock assembly, towards a printed circuit board, of the lock assembly, and consequently a hollow cylinder, of the lock assembly, enters the slit of a stopping member, of the lock assembly, and a biasing means of the stopping member urges the stopping member, as a result a first square-shaped protrusion element, of the lock assembly, prevented from engaging a sprocket wheel cylinder, of the lock assembly, and thus torque is not transferred to the sprocket wheel.

Additional objects and advantages of the invention will be set forth in part in the description which follows and, in part, will be obvious from the description, or may be learned by practice of the invention.

BRIEF DESCRIPTION OF THE DRAWINGS

The invention may be understood upon reading of the following detailed description of non-limiting exemplary embodiments thereof, with reference to the following drawings, in which.

Figure 1A:
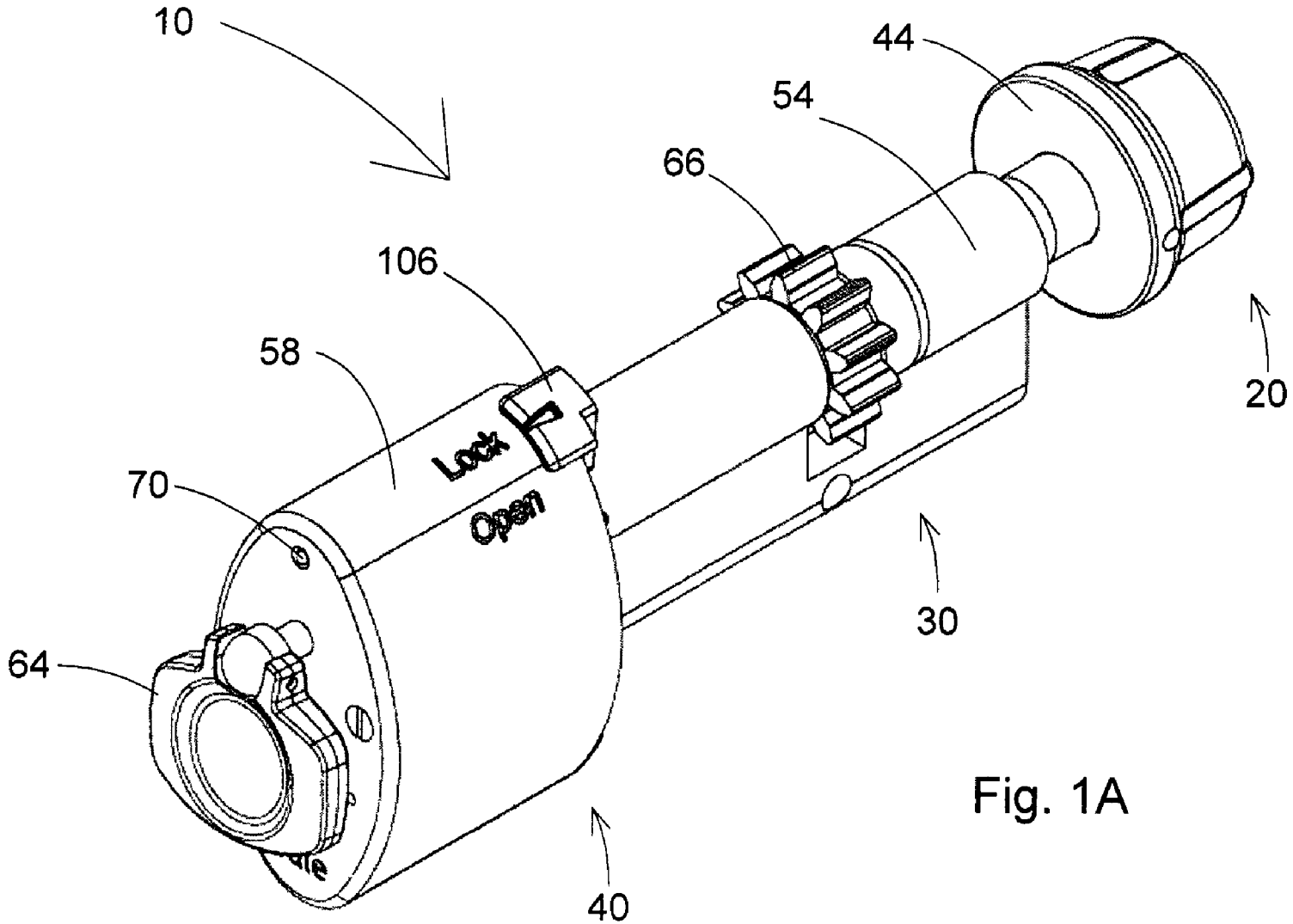
FIG. 1A is a rear isometric view of one embodiment of a mechanically coded lock assembly according to the present invention.

The following detailed description of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF EMBODIMENTS OF THE INVENTION

Before explaining at least one embodiment of the invention in detail, it is to be understood that the invention is not limited in its application to the details of construction and the arrangement of the components set forth in the following description or illustrated in the drawings.

Unless otherwise defined, all technical and scientific terms used herein have the same meaning as commonly understood by one of ordinary skill in the art to which this invention belongs. The materials, dimensions, methods, and examples provided herein are illustrative only and are not intended to be limiting.

The following list is a legend of the numbering of the application illustrations:

10 mechanically coded lock assembly
20 anterior portion sub-assembly
30 intermediate portion sub-assembly
40 posterior portion sub-assembly
42 finger engaging wing
44 exterior drive handle
48 push button
50 position indicating protrusion element
54 lock-cylinder like shaped casing
58 housing
64 interior drive handle
66 sprocket wheel
70 light emitting diode (LED)
80 printed circuit board (PCB)
82 micro-switch
86 electric motor
88 cam
90 power supply
92 micro-switch tongue
93 aperture
94 rod
96 through-hole
98 hollow cylinder
99 second cylinder
100 stopping member
102 protruding element
106 manual actuator's thumb handle
107 slit
108 biasing member
109 flap
110 position selector
111 recesses
116 first square-shaped protrusion element
118 second square-shaped protrusion element
120 sprocket wheel cylinder
122 an interrupter
123 tact switch for code change For convenience, the lock assembly will be described with regard to opening a door; however, the lock assembly can be used in conjunction with any analogous piece of equipment or work piece, etc, comprising a lock.

Figure 1B:
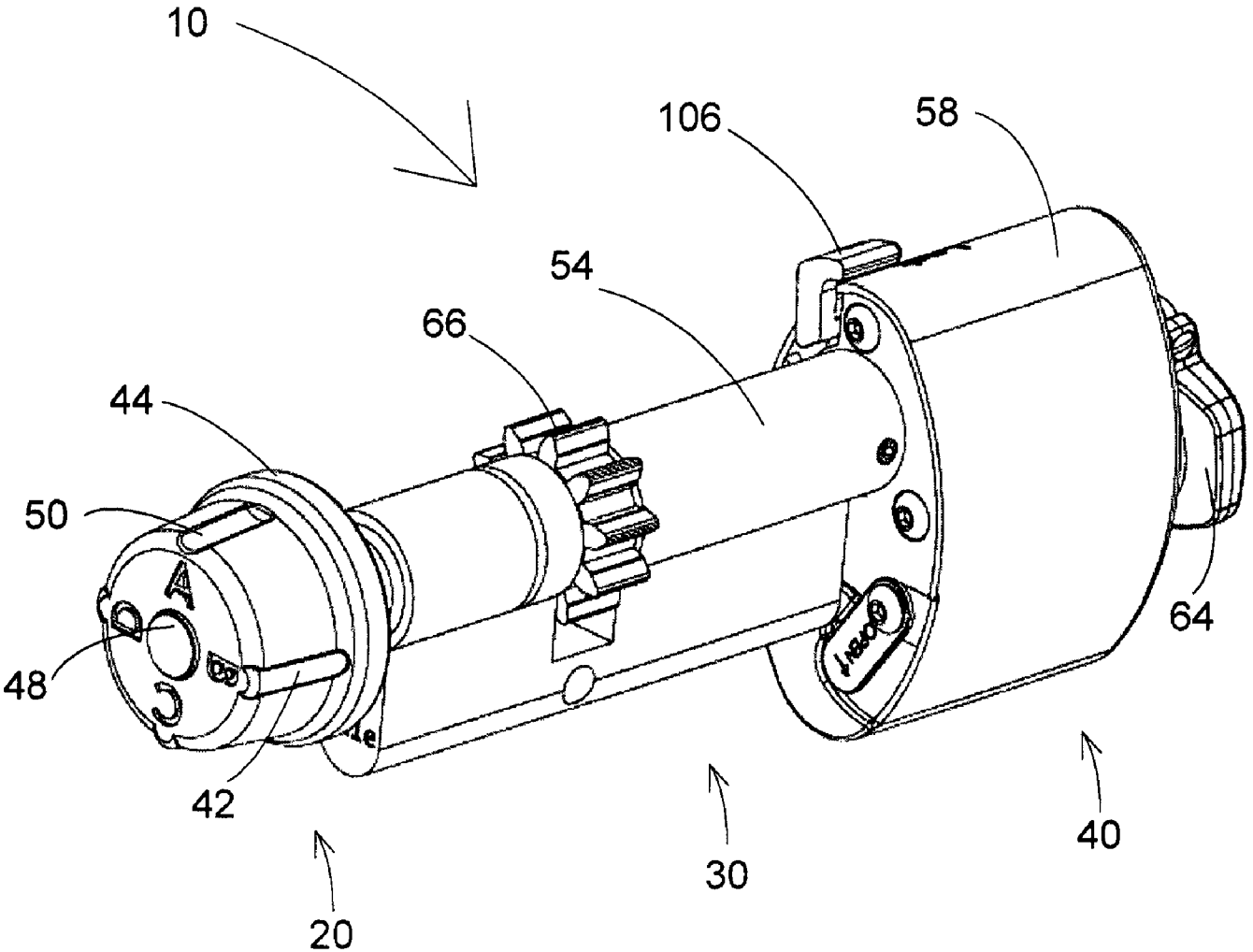
FIG. 1B is a front isometric view of the embodiment of FIG. 1A.

Reference is now made to FIGS. 1A-1B, which is an isometric representation of a mechanically coded lock assembly 10, in accordance with some embodiments of the present invention. Mechanically coded lock assembly 10 has an anterior portion sub-assembly 20, an intermediate portion sub-assembly 30 and a posterior portion sub-assembly 40.

Anterior portion sub-assembly 20 includes an exterior drive handle 44 having at least one finger engaging wing 42 and a push button 48 and a protrusion element 50. Anterior portion sub-assembly 20 is connected through intermediate portion sub-assembly 30 to posterior portion sub-assembly 40. Intermediate portion sub-assembly 30 includes a lock-cylinder like shaped casing 54. Anterior portion sub-assembly 20 is attached to the exterior face of the door (not shown), whereas lock-cylinder shaped casing 54 of intermediate portion sub-assembly 30 is disposed in a cylinder aperture of a standard door-lock (not shown).

Posterior portion sub-assembly 40 is housed in a housing 58, typically located on the interior face of the door, providing access by inhabitants to an interior drive handle 64. A light emitting diode (LED) 70 on housing 58 faces interior drive handle 64 is used for indicating a normal operation of mechanically coded lock assembly 10.

Figure 2A:
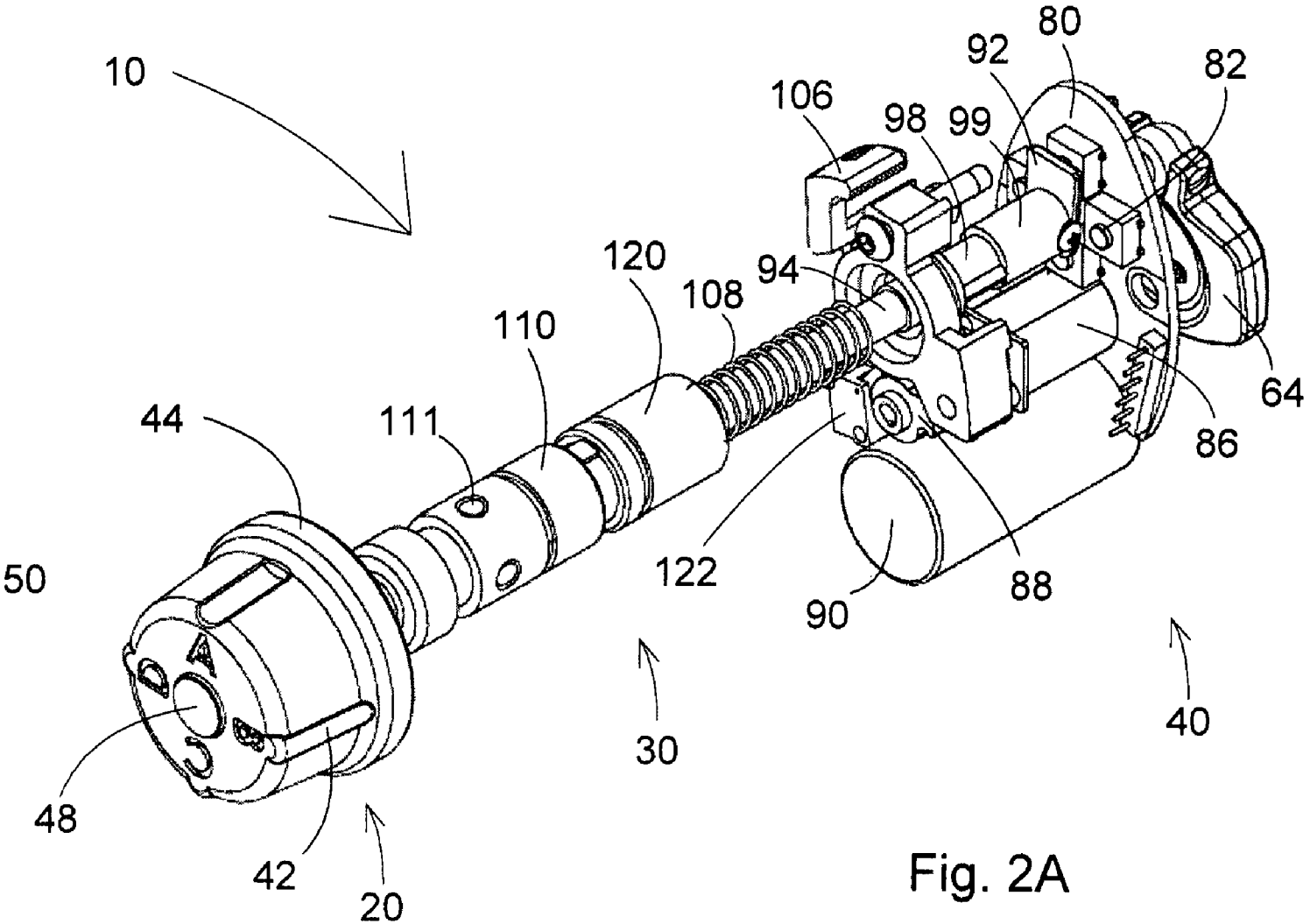
FIG. 2A is a front isometric internal view of the embodiment of FIG. 1A.
Figure 2B:
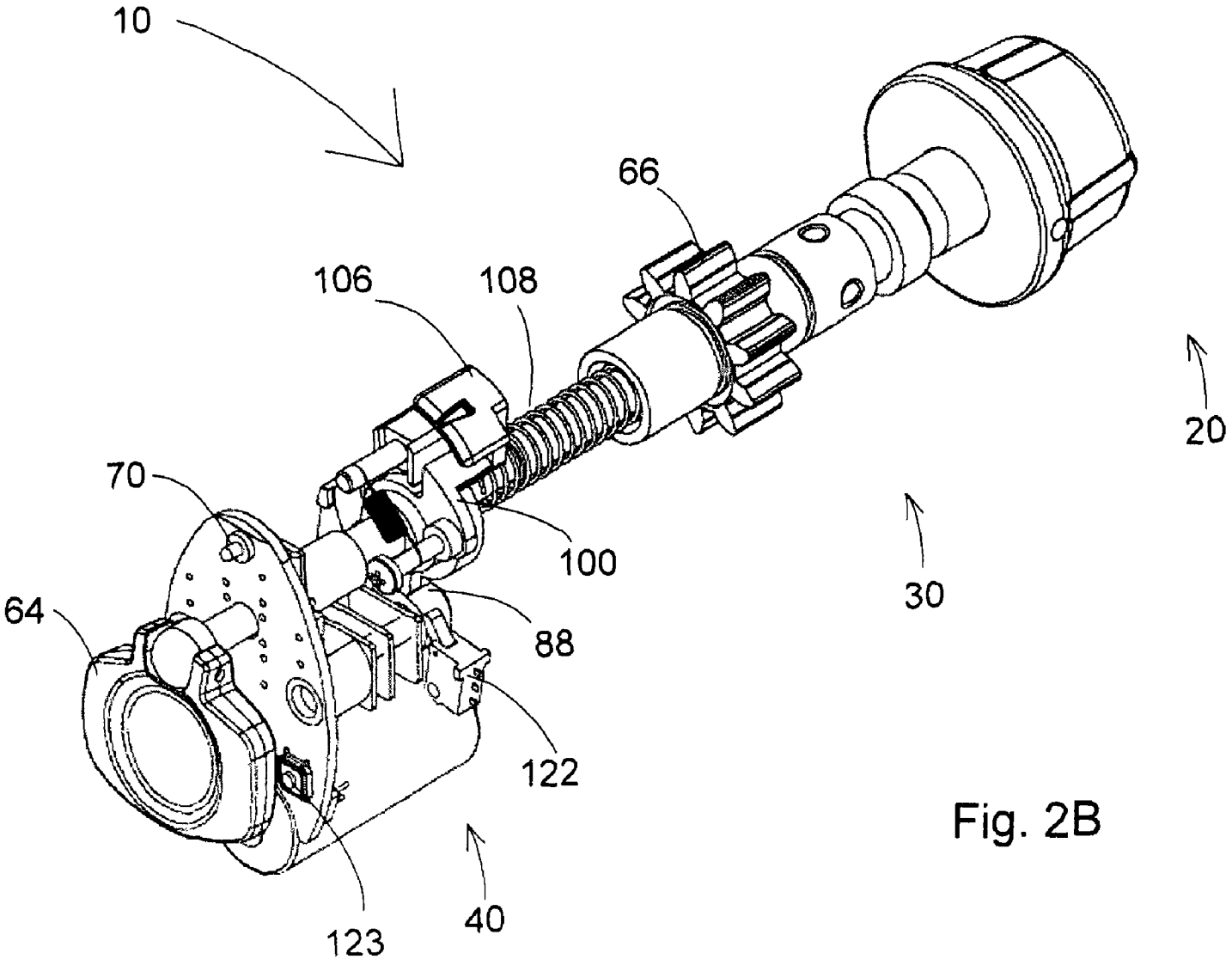
FIG. 2B is a rear isometric internal view the embodiment of FIG. 1B.
Figure 2C:
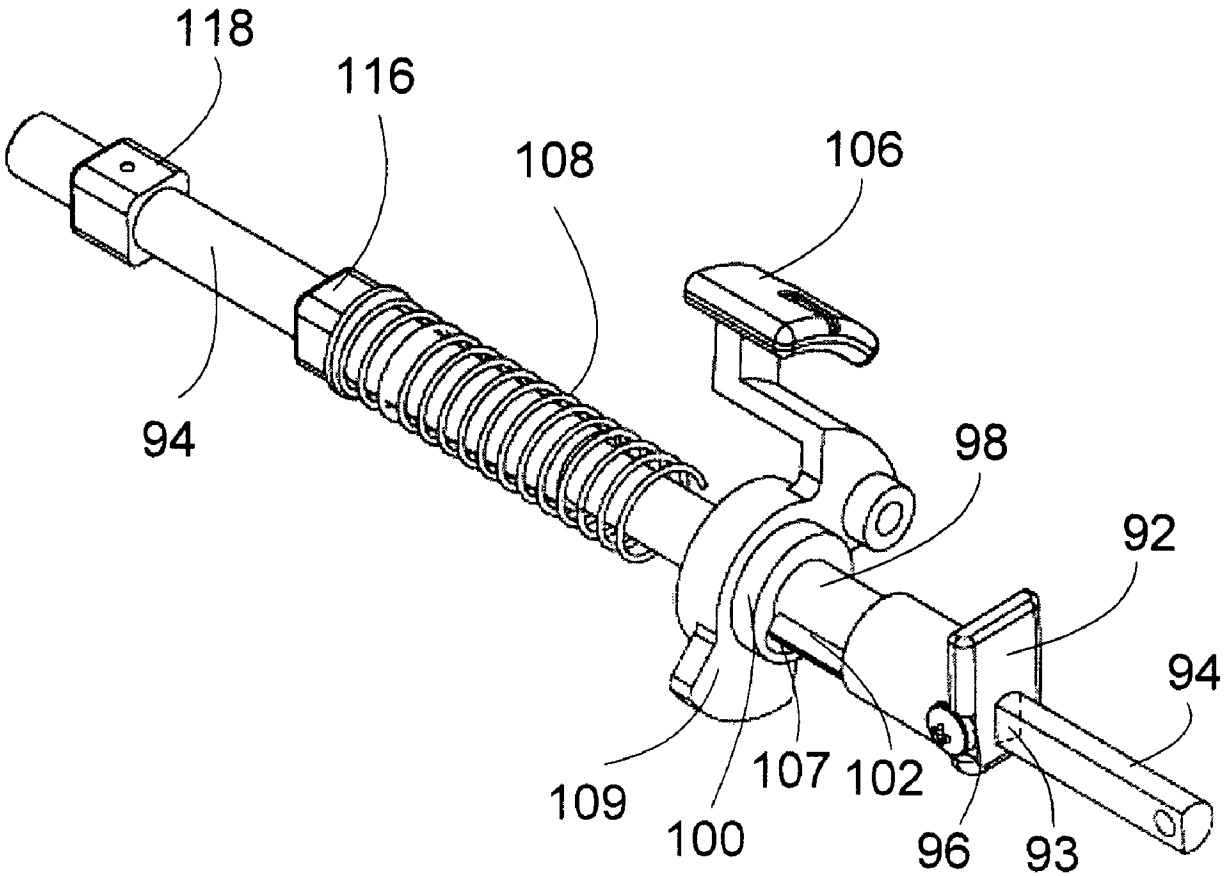
FIG. 2C is an isometric view of particular components of the posterior portion of the mechanically coded lock assembly of FIG. 1A.

Referring now to FIGS. 2A-2C there is shown respectively a rear isometric internal view, a front isometric internal view, and an enlarged view of a portion of posterior portion sub-assembly 40. Posterior portion sub-assembly 40 includes a printed circuit board, (PCB) 80 onto which electronic components such as a plurality of micro-switches 82 are electrically connected. The micro-switches 82 face an exterior drive handle 44. An electric motor 86 of the posterior portion sub-assembly 40 is used for actuating a cam 88. Posterior portion sub-assembly 40 further includes a power supply 90 for example a battery for supplying electrical energy to LED 70, electric motor 86 and the PCB 80 (micro-switches 82, etc). A micro-switch tongue 92 has an aperture 93 where through a rear portion of a rod 94 passes. Tongue 92 is fixed to a rod 94, for example wherein the tongue has through-hole 96 and rod 94 has a through-hole hidden by the tongues, which are aligned with each other, and a pin (not shown) is disposed in those holes. Rod 94 is concentrically disposed in a hollow cylinder 98, the cylinder having an inner diameter larger than the outer diameter of the rod 94 whereby the rod 94 and cylinder 98 can rotate independently. A projection element 102 projects outward from hollow cylinder 98. Rod 94 can freely rotate within hollow cylinder 98. Hollow cylinder 98 is connected to a casing (not shown) preventing cylinder 98 from rotating about the longitude axis of rod 94 and enabling only linear (longitudinal) movement of the rod 94. Hollow cylinder 98 is co-axially arranged within a second cylinder 99 enabling linear movement of cylinder 98 toward the direction of either PCB 80 or handle 44.

A manual actuator thumb handle 106 of posterior portion sub-assembly 40 is used for manually rotating a stopping member 100. Rotatable stopping member 100 can also be rotatable automatically, upon motor activation, cam 88 is rotated and engages flaps stopping member 100 forcing stopping member 100 to rotate. Stopping member 100 is rotationally biased in a clockwise direction, for example by a spring (not shown), operationally enabling protruding element 102 of hollow cylinder 98 to enter a slit 107 in stopping member 100.

Intermediate portion sub-assembly 30 includes biasing member 108 e.g. a spring which biases rod 94 towards the exterior drive handle 44. A position selector 110, for example with a plurality of recesses 111 and corresponding biased projections (not shown), is used for rotating handle 44 in discrete positions where each position corresponds to (aligns with) one of the micro-switches 82.

Operation:

Opening and Locking a Door From the Exterior Side of the Door

When a user is standing outside the door which comprises the mechanically coded locking assembly 10, in order to open the door, the user needs to know in advance the code of micro-switches 82 to be activated. The code is a predetermined sequence of switching of plurality micro-switches 92 by rotating handle 44 and pressing push button 48. Upon rotating exterior drive handle 44, a specific micro-switch 82 is selected and by pressing push button 48 the selected micro-switch is activated from the plurality of micro-switches 82. A position indicating protrusion element 50 operationally determines the current position of tongue 92 and the specific micro-switch 82 that is going to be activated if the user decides to press push button 48. When the user enters the right code of micro-switches 82 the electric motor 86 is activated. Cam 88, which is actuated by the electric motor 86 rotates towards flaps 109 of stopping member 100. Cam 88 interfaces with flaps 109 of stopping member 100 forcing them to rotate to the opposite direction urged by a stopping member spring (not shown) thereby releasing the hollow cylinder 98 from the stopping member 100 and enabling a micro-switch tongue 92 to move in the direction of the exterior drive handle 44 via the biasing member 108.

Rod 94 includes a first square-shaped protrusion element 116 and a second square-shaped protrusion element 118. Within position selector 110 is a square recess or elongated hollow (not seen) corresponding to the second square-shaped protrusion element 118. A sprocket wheel cylinder 120 has a square recess (not seen) corresponding to the first square-shaped protrusion element 116. The engagement between the second square-shaped protrusion element 118 and the square recess of position selector 110 enables transferring rotational torque from the rotational movement of the exterior drive handle 44 to the micro-switch tongue 92. The engagement between the first square-shaped protruding element 116 and sprocket wheel cylinder 120 enables transferring torque from the exterior drive handle 44 for rotation the sprocket wheel 66, which includes at least one cog. The first square-shaped protruding element 116 and sprocket wheel cylinder 120 are engaged when the tongue 92 moves towards the exterior drive handle 44. When the protruding element 102 and the sprocket wheel cylinder 120 are engaged, the sprocket wheel 66 is rotated according to the rotation of the exterior drive handle 44, and the sprocket wheel 66 operatively engages the internal mechanism of the door-lock (not shown) to lock (or unlock) the door.

To lock the door from the outside of the door, the user presses the push button 48 causing the micro-switch tongue 92 to move towards the PCB 80 and consequently, the hollow cylinder 98 passes through the slit 107 of the stopping member 100. At the same time, the biasing means (not shown) of the stopping member 100, urges the stopping member to rotate counter clock-wise. When the user stops pressing the push button 48, the micro-switch tongue 92 which is biased towards the exterior drive handle 44, is freed to move toward the exterior drive handle 44. However as a result of the stopping member 100 rotating e.g. counter clock-wise, the hollow cylinder 98 cannot enter the slit 107 of the stopping member 100 and the first square-shaped protrusion element 116 is not engaging the sprocket wheel cylinder 120 and thus torque is not transferred to the sprocket wheel 66.

Opening and Locking the Door from the Interior Side of the Door

To open the door from the inside, the user rotates clockwise the manual actuator thumb handle 106 which enables the protruding element 102 to enter the slit 107 of the stopping member 100 and consequently, torque is transferable to the sprocket wheel 66 by the interior drive handle 64.

To lock the door from the inside, the user pulls the interior drive handle 64. By doing so, the micro-switch tongue 92 moves towards the PCB 80 and consequently the hollow cylinder 98 enters the slit 107 of the stopping member 100 and the biasing means of stopping member 100, not shown, urges the stopping member 100 to rotate e.g. counter clock-wise. As a result the first square-shaped protrusion element 116 is not been able to engage the sprocket wheel cylinder 120 and thus torque is not been transferred to the sprocket wheel 66.

Figure 3A:
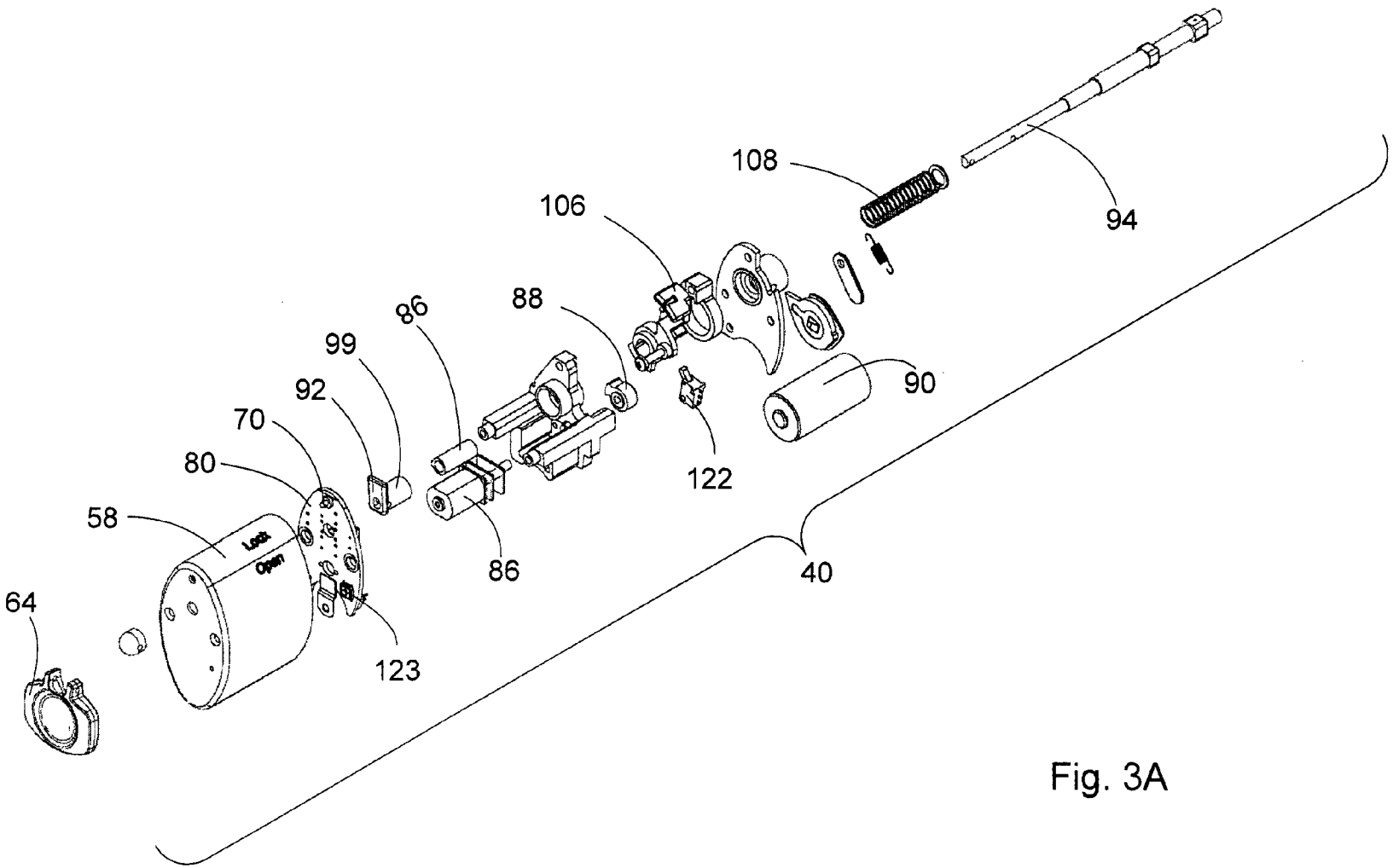
FIG. 3A is an exploded isometric view schematic illustration of a posterior portion, according to an embodiment of the present invention.

FIG. 3A is an exploded isometric view schematic illustrations of a posterior portion sub-assembly 40, according to an embodiment of the present invention.

Figure 3B:
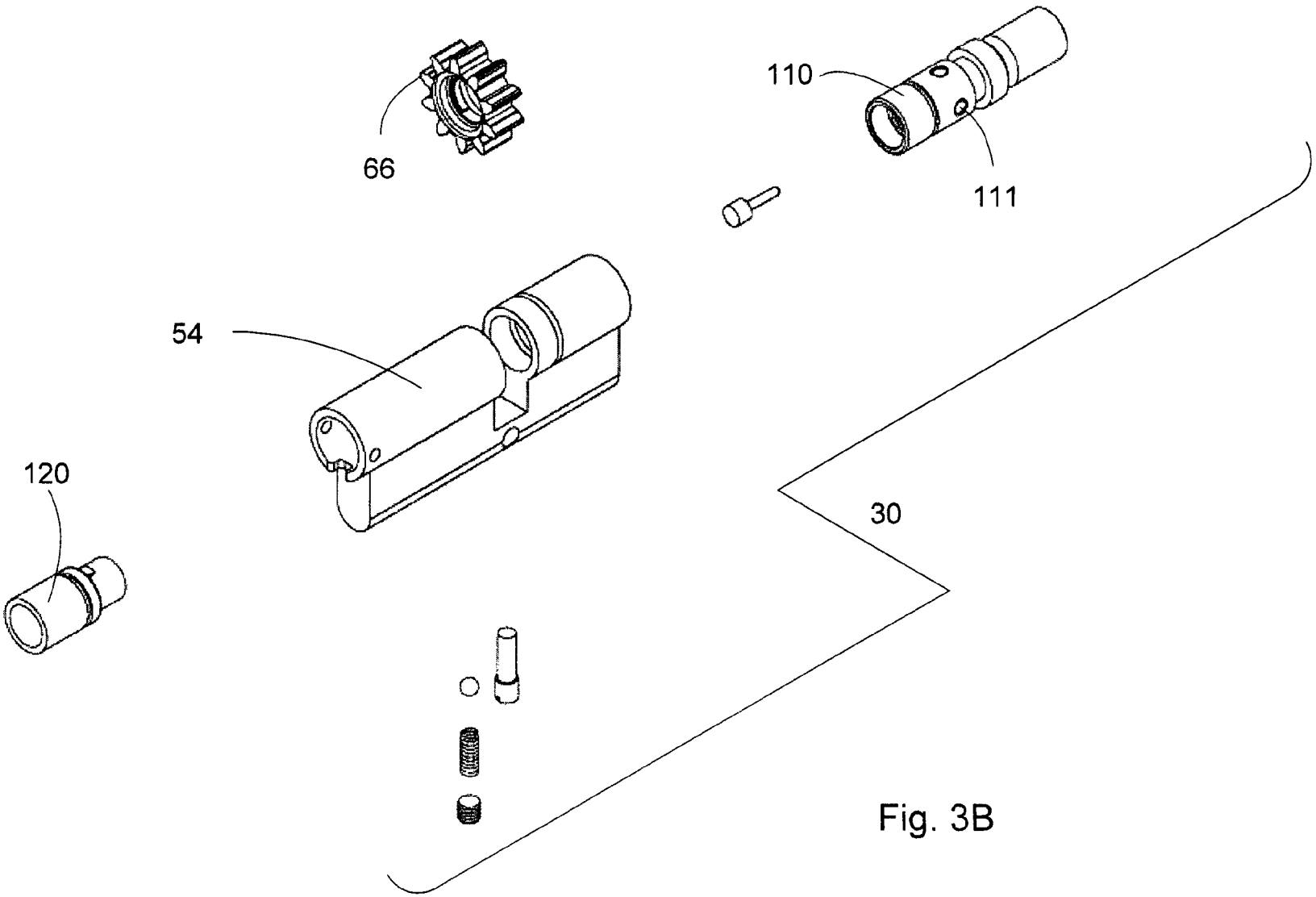
FIG. 3B is an exploded isometric view schematic illustration of an intermediate portion, according to an embodiment of the present invention.

FIG. 3B is an exploded isometric view schematic illustrations of an intermediate portion sub-assembly 30, according to an embodiment of the present invention.

Figure 3C:
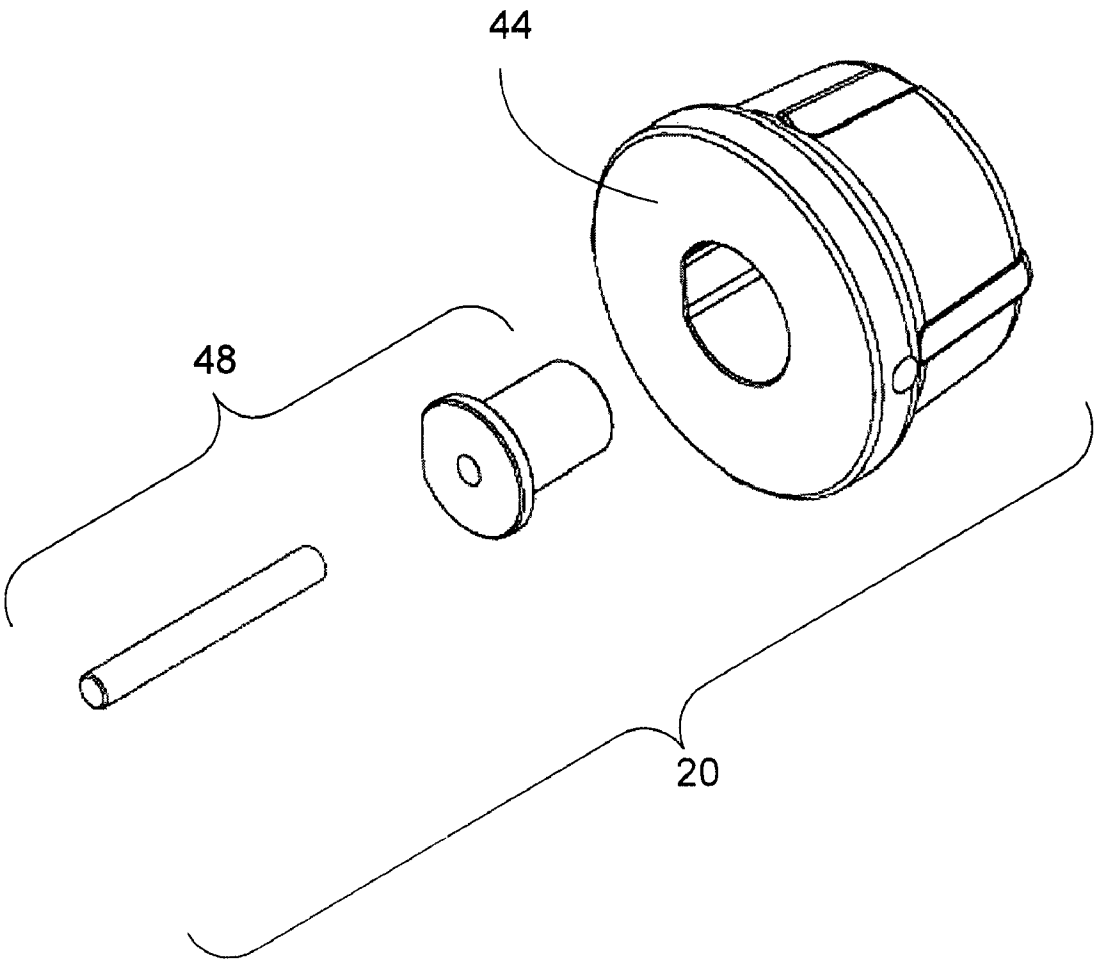
FIG. 3C is an exploded isometric view schematic illustration of an anterior portion, according to an embodiment of the present invention.

FIG. 3C is an exploded isometric view schematic illustrations of an anterior portion sub-assembly 20, according to an embodiment of the present invention.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

What is claimed is:

1. A lock assembly (10) comprising:

(a) an anterior portion sub-assembly, (20) including:

(i) a push button (48); and (ii) an exterior drive handle (44), wherein said exterior drive handle (44) is adapted for rotational motion around said push button;

(b) an intermediate portion sub-assembly (30) including:

(i) a cylindrically shaped casing (54); and (ii) a sprocket wheel (66) adapted for rotational motion with relation to said cylindrically shaped casing (54), wherein said intermediate portion sub-assembly (30) is operatively connected to said anterior portion sub-assembly (20); and (c) a posterior portion sub-assembly (40) including:

(i) a housing (58);

(ii) a printed circuit board (80) mounted inside said housing (58); and (iii) an electric motor (86) mounted inside said housing (58), wherein said posterior portion sub-assembly (40) is operatively connected to said intermediate portion sub-assembly (30).

2. The lock assembly (10) of claim 1, wherein said intermediate portion sub-assembly (30) further includes:

(iii) a sprocket wheel cylinder (120) for transferring torque from said exterior drive handle (44) for rotating said sprocket wheel (66), mounted at least partially inside said cylindrically shaped casing (54); and (iv) a position selector (110) for transferring rotational torque from said exterior drive handle, said position selector (110) having a square recess that is located at least partially inside said cylindrically shaped casing (54).

3. The lock assembly (10) of claim 1, wherein said posterior portion sub-assembly (40) further includes:

(iv) a rod (94) for transferring rotational torque and for transferring linear force, said rod (94) being mounted partially inside said housing (58);

(v) a micro-switch tongue (92) disposed on said rod (94); and (vi) at least one micro-switch (82) disposed on said printed circuit board (80).

4. The lock assembly (10) of claim 3, wherein said posterior portion sub-assembly (40) further includes:

(vii) a cam (88) operatively connected to said electric motor (86);

(viii) a power supply (90) operatively connected to said electric motor (86);

(ix) a hollow cylinder (98) disposed on said rod (94);

(x) a stopping member (100) disposed on said rod (94): and (xi) a flap (109) disposed on said stopping member (100).

5. The lock assembly (10) of claim 4, wherein said posterior portion sub-assembly (40) further includes:

(xii) a protruding element (102) disposed on said hollow cylinder (98);

(xii) a manual actuator thumb handle (106) disposed on said stopping member (100);

(xiv) a biasing member (108) mounted on said rod 94;

(xv) a first square-shaped protrusion element (116) disposed on said stopping member (100); and (xvi) a second square-shaped protrusion element (118) disposed on said stopping member (100).

6. The lock assembly (10) of claim 1, wherein said intermediate portion sub-assembly (30) further includes:

(iii) a sprocket wheel cylinder (120) for transferring torque from said exterior drive handle (44) for rotating said sprocket wheel (66), mounted at least partially inside said cylindrically shaped casing (54); and (iv) a square recess of position selector (110) for transferring rotational torque from said exterior drive handle, said position selector (110) having a square recess that is located at least partially inside said cylindrically shaped casing (54), wherein said posterior portion sub-assembly (40) further includes:

(iv) a rod (94) for transferring rotational torque and for transferring linear force, said rod (94) is mounted partially inside said housing (58);

(v) a micro-switch tongue (92) disposed on said rod (94);

(vi) at least one micro-switch (82) disposed on said printed circuit board (80);

(vii) a cam (88) operatively connected to said electric motor (86);

(viii) a power supply (90) operatively connected to said electric motor (86);

(ix) a hollow cylinder (98) disposed on said rod (94);

(x) a stopping member (100) disposed on said rod (94); and (xi) a flap (109) disposed on said stopping member (100).

7. The lock assembly (10) of claim 6, wherein by rotating said exterior drive handle (44), a specific micro-switch (82) from said printed circuit board (80) is selected and by pressing said push button (48) the selected micro-switch (82) is activated, wherein entering a right code said electric motor (86) is activated, said cam (88) which is actuated by said electric motor (86) rotates towards said flap (109) of said stopping member (100), said cam (88) interfaces with said flap (109) of said stopping member (100) forcing them to rotate thereby releasing said hollow cylinder (98) from said stopping member (100) and enabling said micro-switch tongue (92) to move in the direction of said exterior drive handle (44) for enabling transferring torque from said exterior handle (44) for rotation said sprocket wheel (66).

8. A method of operating a lock assembly (10), said method comprising the stages of:

(a) rotating an exterior drive handle (44) of said lock assembly (10) to at least one predetermined position; and (b) pushing on a push button (48) of said lock assembly (10), at least once according to a predetermined code, causing a manual actuator's thumb handle (106) of said lock assembly (10) to permit a protruding element (102) of said lock assembly (10) to enter a slit (107) of a stopping member (100) of said lock assembly (10), and consequently torque is transferred to a sprocket wheel (66) of said lock assembly (10).

9. The method of operating a lock assembly (10) of claim 8 further comprising the stages of (c) pulling an interior drive handle (64) of said lock assembly (10);

(d) moving a micro-switch tongue (92) of said lock assembly (10) towards a printed circuit board (80) of said lock assembly (10), and consequently a hollow cylinder (98) of said lock assembly (10) enters said slit (107) of a stopping member (100) of said lock assembly (10), and a biasing means (108) of said stopping member (100) urges said stopping member (100) as a result a first square-shaped protrusion element (116) of said lock assembly (10) is prevented from engaging a sprocket wheel cylinder 120) of said lock assembly (10), and thus torque is not transferred to said sprocket wheel (66).

* * * * *